US006702689B2

(12) United States Patent
Ashton

(10) Patent No.: US 6,702,689 B2
(45) Date of Patent: Mar. 9, 2004

(54) GOLF CLUBHEAD FOR PUTTING OR STRIKING A GOLF BALL

(76) Inventor: David Perry Ashton, 226-C Mt. Hermon Rd., Scotts Valley, CA (US) 95066

( * ) Notice: Subject to any disclaimer, the term of this patent is extended or adjusted under 35 U.S.C. 154(b) by 34 days.

(21) Appl. No.: 09/966,211

(22) Filed: Sep. 27, 2001

(65) Prior Publication Data

US 2003/0060305 A1 Mar. 27, 2003

(51) Int. Cl.[7] ..... A63B 53/04; A63B 69/36

(52) U.S. Cl. ..... 473/251; 473/334; 473/337; 473/340; 473/341; 473/342

(58) Field of Search ..... 473/305, 306, 473/307, 308, 309, 310, 311, 312, 313, 314, 315, 327, 328, 340, 341, 342, 349, 350, 251, 249, 252, 255, 330, 331, 334, 335, 337

(56) References Cited

U.S. PATENT DOCUMENTS 4,173,343 A * 11/1979 Richilano ..... 473/251
4,253,667 A 3/1981 Clark et al.
4,325,553 A * 4/1982 Taylor
4,411,430 A 10/1983 Dian
4,512,577 A 4/1985 Solheim
4,655,459 A * 4/1987 Antonious ..... 473/338
4,714,252 A 12/1987 Roraback
4,747,599 A * 5/1988 Antonious
4,871,174 A * 10/1989 Kobayashi
4,948,140 A * 8/1990 Antonious
4,964,639 A * 10/1990 Tucker
5,246,231 A * 9/1993 Antonious
5,344,149 A * 9/1994 Miller
5,417,429 A * 5/1995 Strand ..... 473/251
5,700,206 A 12/1997 Lin
5,766,093 A 6/1998 Rohrer
5,769,736 A 6/1998 Sato
5,816,930 A 10/1998 Brown
5,890,969 A 4/1999 Bechler
5,913,731 A * 6/1999 Westerman
5,947,837 A * 9/1999 Perry
5,951,412 A 9/1999 Rose et al.
5,961,400 A 10/1999 Broom
5,993,324 A 11/1999 Gammil
6,045,452 A * 4/2000 Ahn et al. ..... 473/249
6,045,453 A 4/2000 Jenkins
6,379,264 B1 * 4/2002 Forzano
6,497,628 B1 * 12/2002 Gunderson

* cited by examiner

*Primary Examiner*—Sebastiano Passaniti
(74) *Attorney, Agent, or Firm*—Tran K Associates

(57) ABSTRACT

An improved golf club-head having a hollowed strike-barrel (10) centrally located and positioned parallel on the golfer's intended target line for more precise alignment and efficient on-target stroke. The mass of strike-barrel walls (16) in a graduating manner providing additional force behind the usual-mis-hit-area, therefore compensating for the misdirection and the loss of velocity on off-center strikes. The strike-barrel pocket (12), and any additional pockets in the rear of arms (40), hosel (44), and the heel and toe (42), providing a significant air drag when the club-head is swung back from the ball, thereby slowing the golfer's backswing. The strike-barrel (10) having bead-mark sights (49) and (28) on its parallel axis along the target line for improved alignment and stroke. An elongated hosel-base (32) provides assistance to the golfer in keeping the clubhead on track longer.

17 Claims, 11 Drawing Sheets

GOLF CLUBHEAD FOR PUTTING OR STRIKING A GOLF BALL

CROSS-REFERENCE TO RELATED APPLICATIONS

Not applicable.

BACKGROUND—FIELD OF INVENTION

This invention relates to golf club heads; specially to an improved clubhead for putters.

BACKGROUND—DESCRIPTION OF PRIOR ART

Golfers, for centuries, have been struggling for greater distance, accuracy, and consistency on their golf shots. Therefore, inventors have created hundreds (perhaps thousands) of different types of golf clubs to improve these functions by providing:

1. More effective results from imperfect shots, to achieve more consistency;
2. Better alignment features, to improve accuracy;
3. Greater efficiency for the club ball strike, to increase distance.

I Off-center club ball impact constitutes a large percentage of imperfect golf shots. A ball that is struck away from the sweetspot, deflects the club at impact. The force of the ball-club contact towards the toe or the heel causes the clubhead to open or close, sending the ball away from the intended target line, resulting in misdirection of the ball and an other than anticipated impact force. Off-center impact is especially important for putters, as even a slight deflection can cause a loss of a stroke. A great majority of golfers tend to miss the sweetspot by up to approximately 15 mm for putters, and up to 25 mm for irons and woods (the usual-mis-hit-area). This problem has been attempted and only partially solved by increasing the heel-toe weighting suggested by many previous inventions such as U.S. Pat. No. , 226,654, U.S. Pat. No. 3,042,405 Solheim, U.S. Pat. No. 4,243,472, U.S. Pat. No. 4,714,252 Roraback 1987, U.S. Pat. No. 5,816,930, U.S. Pat. No. 5,913,731 Westerman 1999, U.S. Pat. No. 5,951,412, U.S. Pat. No. 5,961,400. Further invention by U.S. Pat. No. 5,766,093 Rohrer, uses many solid layers of different materials situated side-by-side for the club head construction to improve off-center impacts; but this solution is only partially effective in addition to being costly to manufacture. The off-center contact remains one of the worst problems in a golf swing, especially for the higher-handicapped golfer.

II The alignment of the clubhead at address is twofold. It involves lining up the clubface perpendicular to the target and the alignment of the effective center of the clubhead (sweetspot) to the center of the ball, and on the target line. Good alignment is critical, especially for putters. It is a given that occasionally these alignments may be deviated from by the expert golfer for certain types of shots. My experience is that golfers usually use one or more of the following methods to align the clubhead to the ball and the target when addressing the ball:

a—Alignment with focus on placing the leading edge of the club positioned at 90 degrees to the ball-target-line (perpendicular aiming). It is not an easy task for most golfers to align the leading edge (perpendicular axis) of a clubhead at exactly 90 degrees to an imaginary target line. It is, however, easier to align a visually strong horizontal axis (positioned parallel to the target), if one was provided. But, a clubhead with the longer axis going towards the target is prohibited by the rules of golf (as governed by the United States Golf Association and the Royal and Ancient Golf Club of St. Andrews). Aligning the clubface perpendicular to the target is made more complex given the fact that the shaft and the clubhead must form an angle (approximately 10 to 40 degrees from vertical). Several T-shaped, U-shaped, H-shaped, and E-shaped putter-heads have been previously invented, U.S. Pat. No. 2,957,696, U.S. Pat. No. 3,758,115, U.S. Pat. No. 3,888,204, U.S. Pat. No. 4,411,430 Dian 1983, U.S. Pat. No. 4,253,667 Clark 1981, U.S. Pat. No. 4,964,639 Tucker 1990, U.S. Pat. No. 5,244,151 Anderson (1994), U.S. Pat. No. 5,890,969 Becher 1999, U.S. Pat. No. 5,993,324 Gammil 1999, U.S. Pat. No. 6,045,453 Jenkins 2000. These clubs provide a long horizontal axis to assist in parallel alignment,; however, due to the wide body shape, an imperfect stroke will tend to catch the bottom of the clubhead on the ground prior to contact with the ball. Other problems with the above teachings are that the face of the club (perpendicular member) is still a dominant visual feature which contradicts the provided horizontal axis. Additionally, in these inventions the horizontal member is made solid, placing the weight of the clubhead centered directly behind the ball. With this weight behind the sweetspot, the golfer will experience a heavy impact when the ball is stroked on the sweetspot; but will lose distance and accuracy when the ball is struck away from the center, on the perimeter of the sweetspot. Many other inventions as in U.S. Pat. No. 3,206,755; U.S. Pat. No. 3,679,207; U.S. Pat. No. 5,700,206, propose a croquet style of putter clubhead and stroke which is not within the current rules of golf.

b—Alignment using any available lines, dots, or other markings provided on top or face of the club designating the club's sweetspot, parallel and on the ball target line (parallel aiming). Conventional markings on top or on the face of clubs give a skewed perspective from the golfer's view at address position (standing to the side of the ball-target line), especially for irons and woods since the golfer is standing farther from the ball. In addition, the markings on the club in some cases do not represent the true center of the clubhead.

c—Alignment using the overall shape of the club (the entire clubhead). Some golfers tend to place the club behind the ball without specific regard to any provided markings or the leading edge of the club. Conventional clubheads do not provide an intuitive alignment feature to assist these golfers in making a precise alignment using the overall clubhead shape.

In addition to the above alignment techniques, the sole (bottom) of the clubs have been traditionally constructed relatively flat or with a slight curve, therefore, not of significant help to the golfer with alignment. It is well documented that the golfers of all abilities continue to have difficulty with their club alignments.

III Efficiency of the strike depends partly on the effectiveness of the golfer's swing. It is generally accepted that in an effective golf swing, especially in a putting stroke, the clubhead should remain on the intended swing plane arc and not easily go off track. In addition, during the swing the club should go back slower on the back swing than it goes forward in the forward swing. Conventional clubheads do not provide sufficient assistance to the golfer in taking the club back slower on the backswing, and lack adequate aerodynamic qualities to prevent the club from going off-track while the club is being swung above ground.

One of the most common problems in a golf stroke, especially in putting, is pulling the clubhead across the ball too quickly to the inside of the target line during impact. Ideally the leading edge of club should stay perpendicular to the target at and immediately after impact with the ball (for a normal shot). The hosel, which is the transition between the shaft and the clubhead, is typically a narrow stem and is not of much assistance in keeping the stroke parallel to the target and keeping the heavy clubhead on track at the moment of contact with the ball, especially on off-center hits. An example of a conventional hosel can be found in U.S. Pat. Nos. D20926, 4,512,577, and 5,769,736.

DESCRIPTION OF DRAWINGS

FIG. 2—2 is a sectional view showing the variable walls thickness of strike-barrel, a thin sweetspot, a large strike-barrel pocket, and a clubface-insert.

FIG. 3—3 is a top cross sectional view showing the walls thickness and pocket depth of the entire putter clubhead, and large glue-notches inside the arm pockets.

| DRAWING FIGURES | |
|---|---|
| 10 Strike-barrel | 12 Strike-barrel pocket |
| 14 Top ridge of strike-barrel | 16 Strike-barrel walls |
| 18 Aims | 20 Heel/toe |
| 22 Heel/toe projections | 24 Channel/space between arm & strike-barrel |
| 26 Face-plate | 28 Shaft (not shown in entirety) |
| 30 Hosel | 32 Widened hosel-base |

-continued

| DRAWING FIGURES | |
|---|---|
| 34 Arm projections | 36 Clubhead sole |
| 38 Clubface grooves | 40 Arm pockets |
| 42 Heel/toe pockets | 44 Hosel pockets |
| 46 Glue-notches | 48 Clubface insert |
| 49 Front bead-mark | 50 Rear bead-mark |

SUMMARY

In accordance with the present invention, a golf club-head comprises a parallel member, with a pre-determined mass gradually placed behind the usual mis-hit area of the club-face, and rear pockets to slow the golfer's backswing.

OBJECTS AND ADVANTAGES

This invention, an improved clubhead, has many objects among which are:

I To Make alignments Easier.

It is the objective of this invention to create clubheads which will be easier to align to the center of the ball and also easier to align the center of the club to the target line by providing:

a—More intuitive parallel alignment features.

b—More effective perpendicular alignment features.

c—A clubhead with an easier overall shape for alignment to the ball and the target.

d—An additional alignment feature; using the bottom of the clubhead.

II To Reduce the Loss of Effectiveness Incurred from Off-Center Strikes.

By providing a weight placement system which compensates for off-center impacts made either in heel-toe or crown-sole direction. This system in addition to the heel-to-toe-weighting, will produce closer to the same result as if the impact was made on the sweetspot.

III To Facilitate a more Efficient Golf Swing.

By providing a visually strong parallel axis in the clubhead so that the golfer can swing the clubhead parallel along the target line rather than attempting to sweep the clubhead perpendicular to the target.

By making it easier for the golfer to have a better golf swing rhythm by helping to slow the golfers backswing while rendering the forward swing speed unaffected.

By providing an aerodynamic clubhead, to keep the clubhead on track while being swung above ground.

By providing a hosel, which is the connection between the clubhead and the shaft, constructed and positioned in such a manner as to reduce the golfer's tendency to pull the clubface to the inside too early, and help the golfer in keeping the clubhead on track.

DESCRIPTION—FIGS. 1, 2, 3, 4, and 5—Preferred Embodiment

The specifications herein describe a putter clubhead. Description of iron and metalwood clubheads will be described in the alternative embodiments section.

Figure 1:
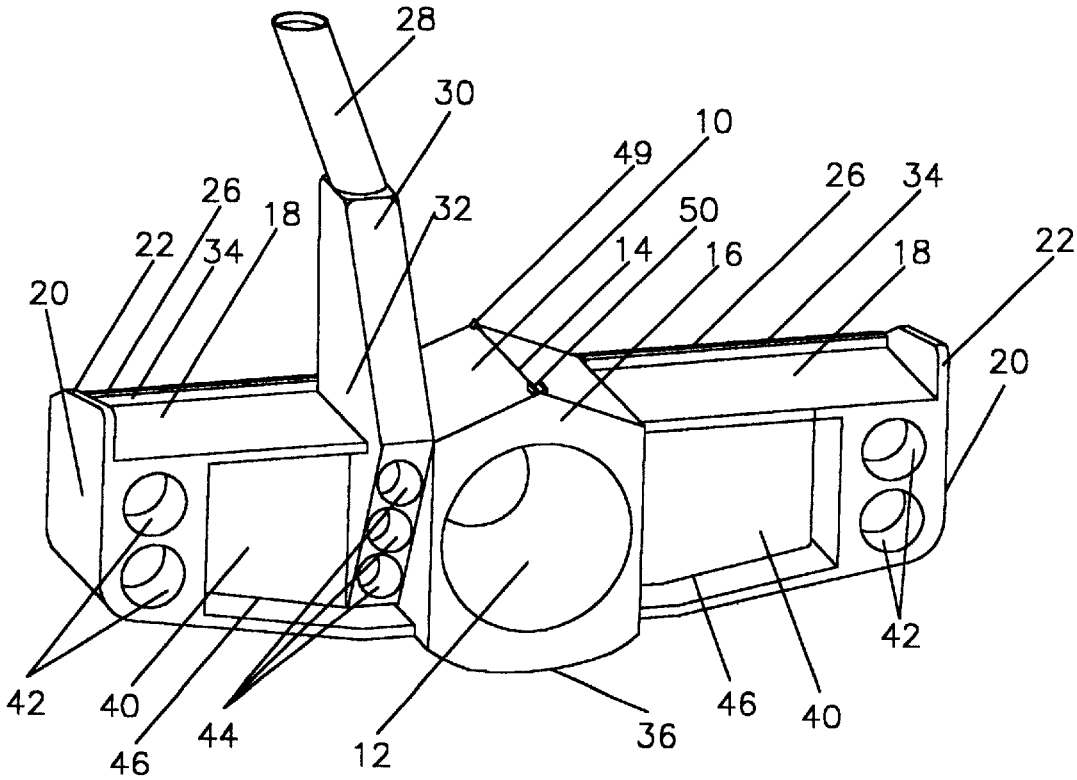
FIG. 1 is a rear heel-side perspective view of a putter-clubhead embodying this invention. The figure also shows the lower portion of the over-the-hosel shaft, but the upper part of shaft and grip are not shown.

FIG. 1 shows the rear perspective view from the heel-side of the preferred embodiment of the present invention. My putter clubhead consists of a hollowed tubular shape similar to an abbreviated six-sided gun barrel, named a strike-barrel 10. Clubhead sole 36 is the rounded and somewhat flattened bottom side of strike-barrel 10. Strike barrel 10 is opened from the rear to near the very front of clubhead to create strike-barrel pocket 12. Arms 18 sandwich strike-barrel, which more or less constitutes the center portion of the clubhead. Arm pockets 40 are the openings of each arm from the rear. Hosel 30 is somewhat triangular in shape and connects the shaft 28 to clubhead. The lower portion of hosel 30 contains pockets 44 which are open-ended from the rear. Without hosel 30, the clubhead is generally symmetrical from heel to toe. The heel and toe of the clubhead which are the natural extension of arms 18 each contain pockets 42. Arms 18 are uplifted in the front to form arm projections 34, and uplifted at the heel and toe extremities to form heel/toe projections 22.

Figure 2:
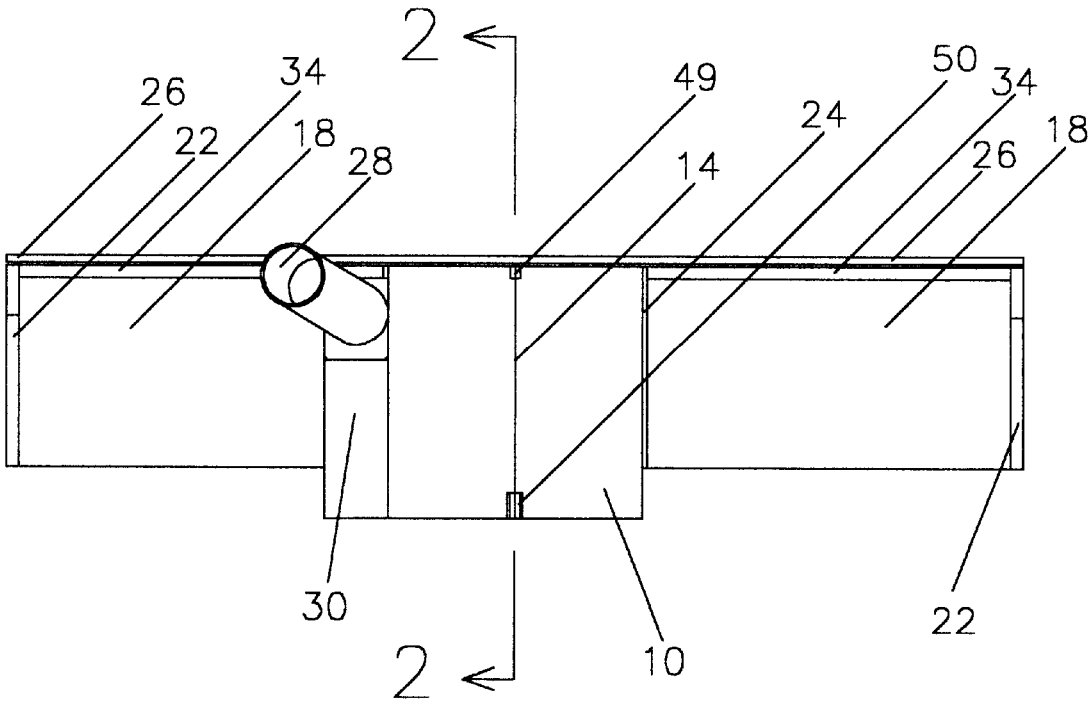
FIG. 2 is a top view of putterhead showing a relatively thin face-plate, and the channel between arms and strike-barrel.
Figure 2:
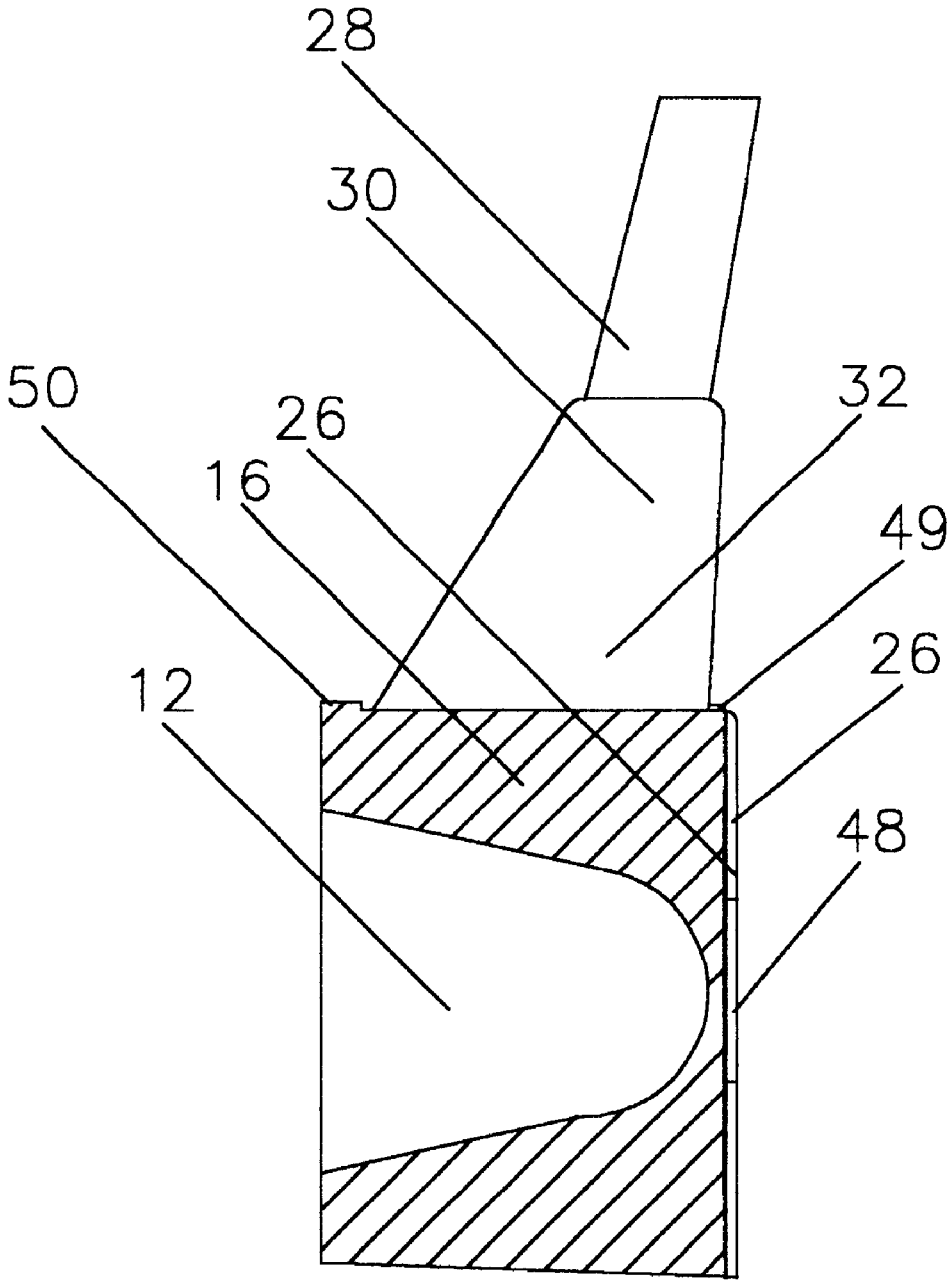

FIG. 2 (top view), shows top ridge 14 which is a natural edge of two of the top sides, in a multi-sided strike-barrel. Face-plate 26 covers the front of arms and strike-barrel, and is situated at a 90 degree angle to top ridge 14. Bead-marks 49 and 50 are constructed to resemble gun barrel sights on top center front and rear extremities of strike-barrel. Channel 24 is a narrow gap between arms and strike-barrel. Arm projections 34 and heel/toe projection 22 are narrow vertical ridges slightly raised from the top surface of arms.

FIG. 2—2 (side cross-section). Shows the walls construction of strike-barrel, and depth of strike-barrel pocket 12. Strike-barrel walls 16 taper towards the middle to form the thinnest segment of the front portion of clubhead. Face-plate 26 constitutes the front of the clubhead. Clubface-insert 48 is located in the center of face-plate 26 and covers the thinnest portion of strike-barrel walls 16.

Figure 3:
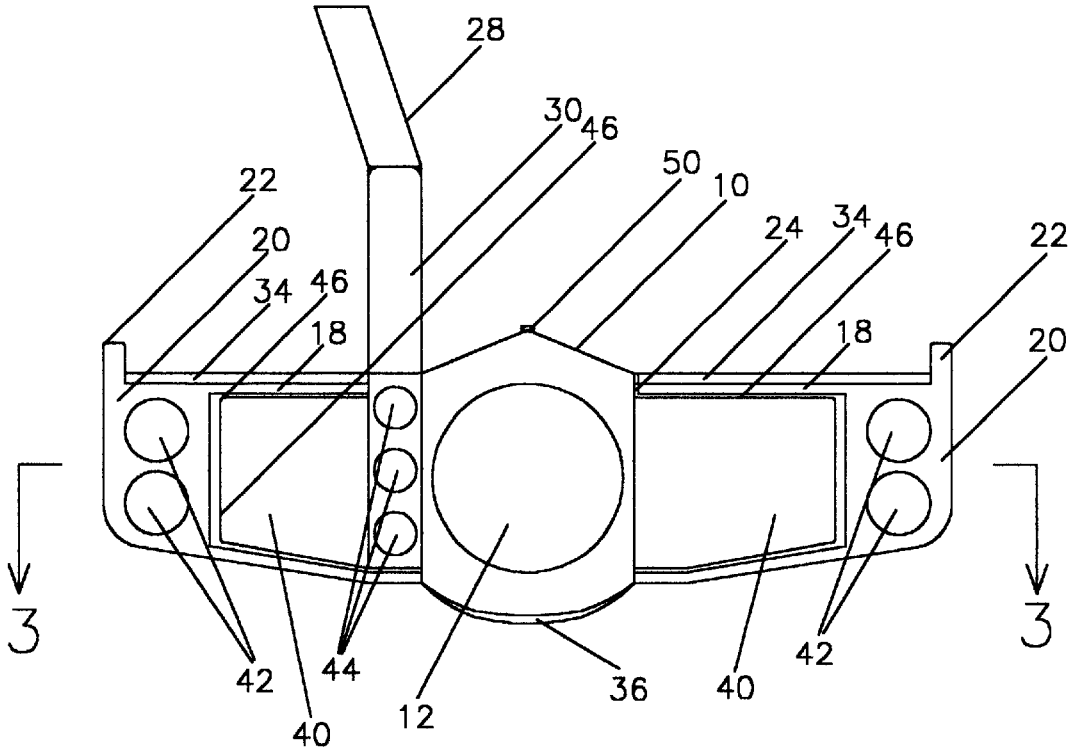
FIG. 3 is a rear view of putterhead, showing pockets in arms, heel/toe, strike-barrel, and hosel.
Figure 3:
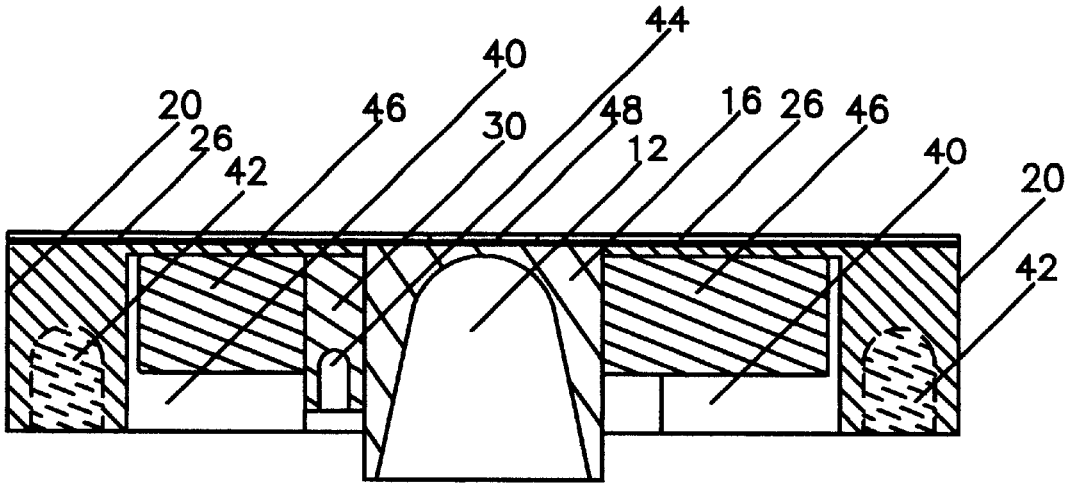

FIG. 3 (rear view) shows the open pockets provided in the rear of the clubhead, namely strike-barrel pocket 12, arm pockets 40, heel and toe pockets 42, and hosel pockets 44. Glue-notches 46 are somewhat cubical in shape, and positioned on the sides of strike-barrel for adhering strike-barrel to arms and provides a mass behind the arms. The vertical dimension of strike barrel is longer, therefore extends above and below the vertical dimension of arms. Strike-barrel's bottom edge forms clubhead sole 36, is semi-circular in shape and approximately resembling the cross section of a golf ball resting on the grass in shape and size. Clubhead sole 36 angles upward from front to the rear of the clubhead. The top and underneath sides of arms are constructed somewhat parallel to one another, meeting near the extremities to form heel/toe 20. The underside of arms are at a slight angle upward from parallel to the ground towards heel/toe 20.

FIG. 3—3 (top cross-section). Shows the walls construction of the putterhead from above, indicating the depth of arm pockets 40, heel and toe pockets 42, and strike-barrel pocket 12. Arm pockets 40 are formed by indenting glue notches 46 from the rear of clubhead.

Figure 4:
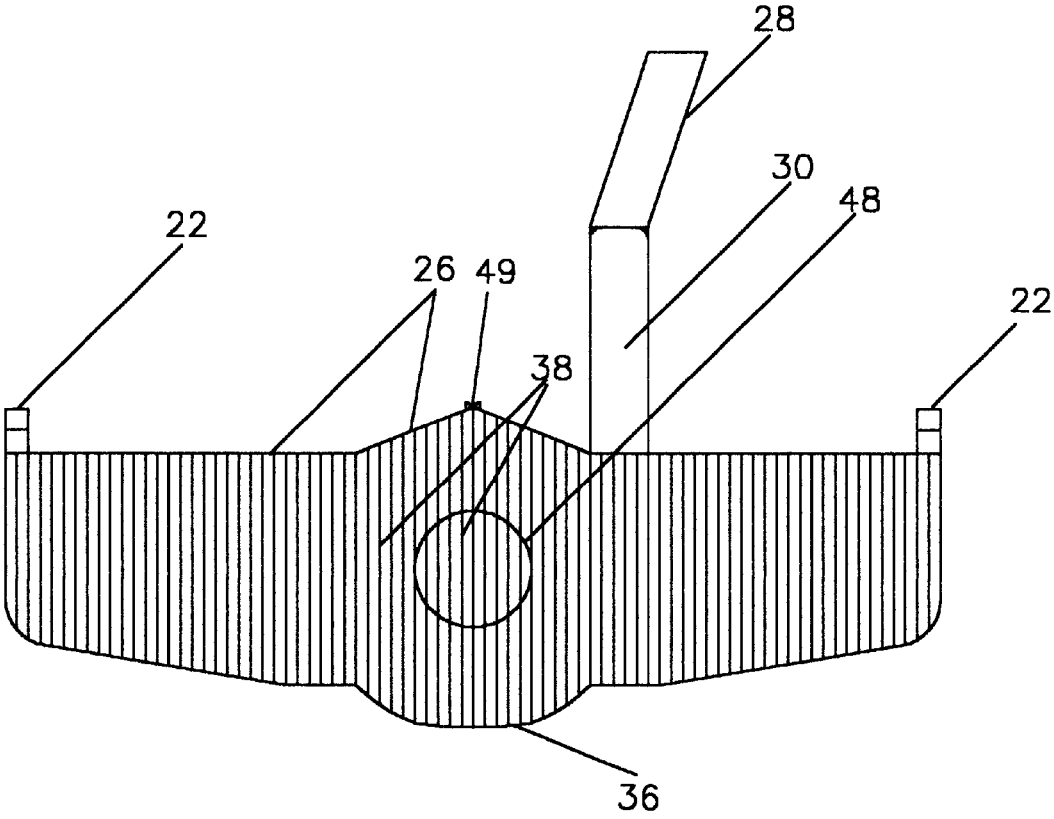
FIG. 4 is a front view, showing the club face-plate with a clubface-insert and vertical grooves on face-comprising the clubface. This figure also shows the arm members angle upward towards the toe/heel, and the somewhat flattened sole of the strike-barrel.

FIG. 4 shows the front view of the putterhead. Face-plate 26 forms the face of the clubhead. Clubface-insert 48 is constructed approximately on the center of face-plate 26 indicating the sweetspot. Clubface grooves 38 are vertical scoring lines on front of face-plate 26.

Figure 5:
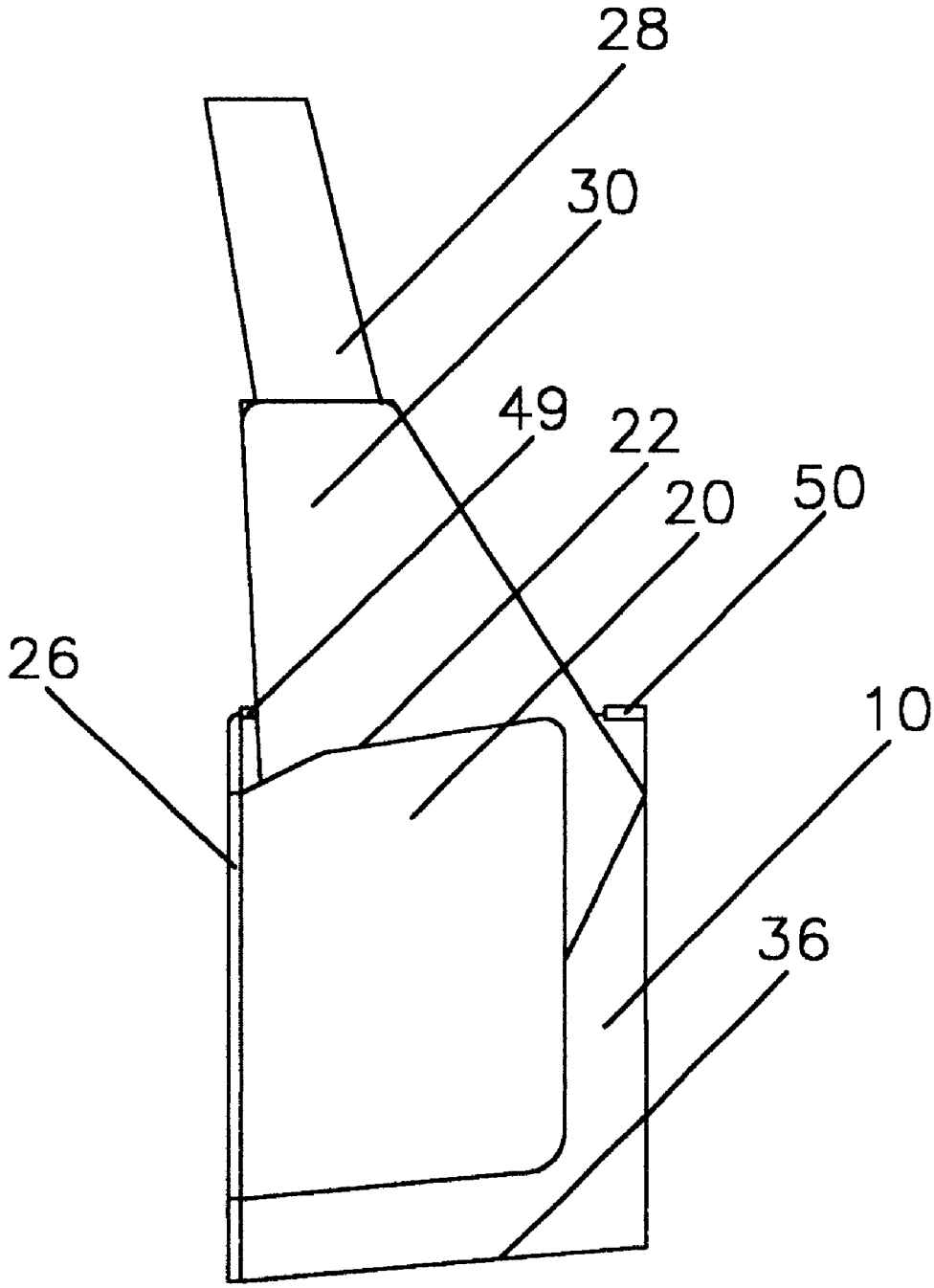
FIG. 5 is a side view of putterhead shown from the heel side, a triangular shape hosel, and heel projection in two different angles going up in the rearward direction.

FIG. 5 (side view), shows strike-barrel extends rearward farther than heel/toe 20. The underneath portion of strike-barrel, arms, and heel/toe 20 are at an upward angle from front to rear of clubhead. Heel/toe projections 22 are constructed at a slight angle upward from front to rear, this angle lessening approximately a third of way back. Hosel 30 is somewhat triangular, constructed on the heel side of strike-barrel, slightly narrow on top and widening gradually towards the base which is attached to strike-barrel. Widened hosel-base 32 is positioned longitudinally in the direction of the target. Top portion of hosel 30 is relatively smaller than the base and cylindrical in shape, constructed to receive an over-the-hosel shaft 28 (not shown in its entirety). This top portion is angled at least 10 degrees from vertical towards the heel and is bent forward towards the face to create a slight offset from the leading edge of the clubhead. The imaginary extension of the shaft plane intersects the center of the sweetspot for a putter.

Figure 9:
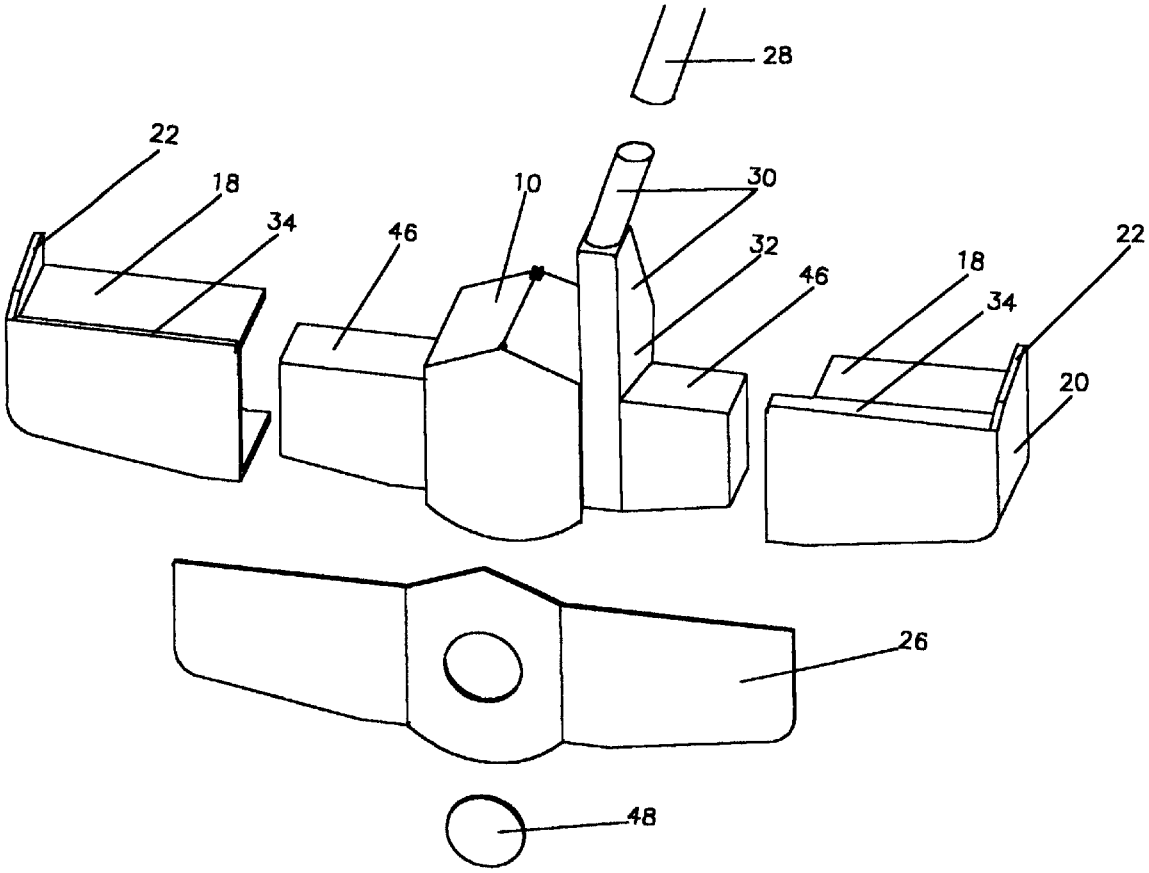
FIG. 9 is the exploded view showing the separate pieces comprising this embodiment of a putter clubhead. One strike-barrel central body, two arm and heel/toe members, one face-plate, and one clubface-insert. The clubface grooves (scoring lines) are omitted for simplicity.

FIG. 9 shows a front heel-side exploded view of the preferred embodiment that consists of five separate pieces permanently attached together. In other embodiments, the clubhead may be constructed in one or any number of pieces. In this embodiment, strike-barrel, hosel 30, and glue-notches 46 are in one piece made of aluminum alloy. Heel/toe, and arms are made of 17–4 stainless steel. Face-plate 26 is a thin layer of nickel-steel. Clubface-insert 48 is made of a thin layer of gold or silver alloy about 1 mm in thickness.

Additional Embodiments

An iron clubhead uses some of the elements specified in the preferred embodiment for a putter clubhead. Heel and toe projections and width of hosel-base are reduced, while the arm pockets and heel and toe pockets are more numerous and more shallow.

A metalwood clubhead is constructed with a strike-barrel with its walls thickness placed behind the mis-hit-area, but the entire strike-barrel may be enclosed inside the head. An iron or wood clubhead have a larger mis-hit-area as described earlier; therefore, in these embodiments strike-barrel is relatively larger and more oval in shape.

Alternative Embodiments

There are various possibilities especially for a putter clubhead in regards to the strike-barrel, heel/toe projections, the underneath portion (sole) of the clubhead, and to the coupling of the shaft to clubhead.

Figure 6:
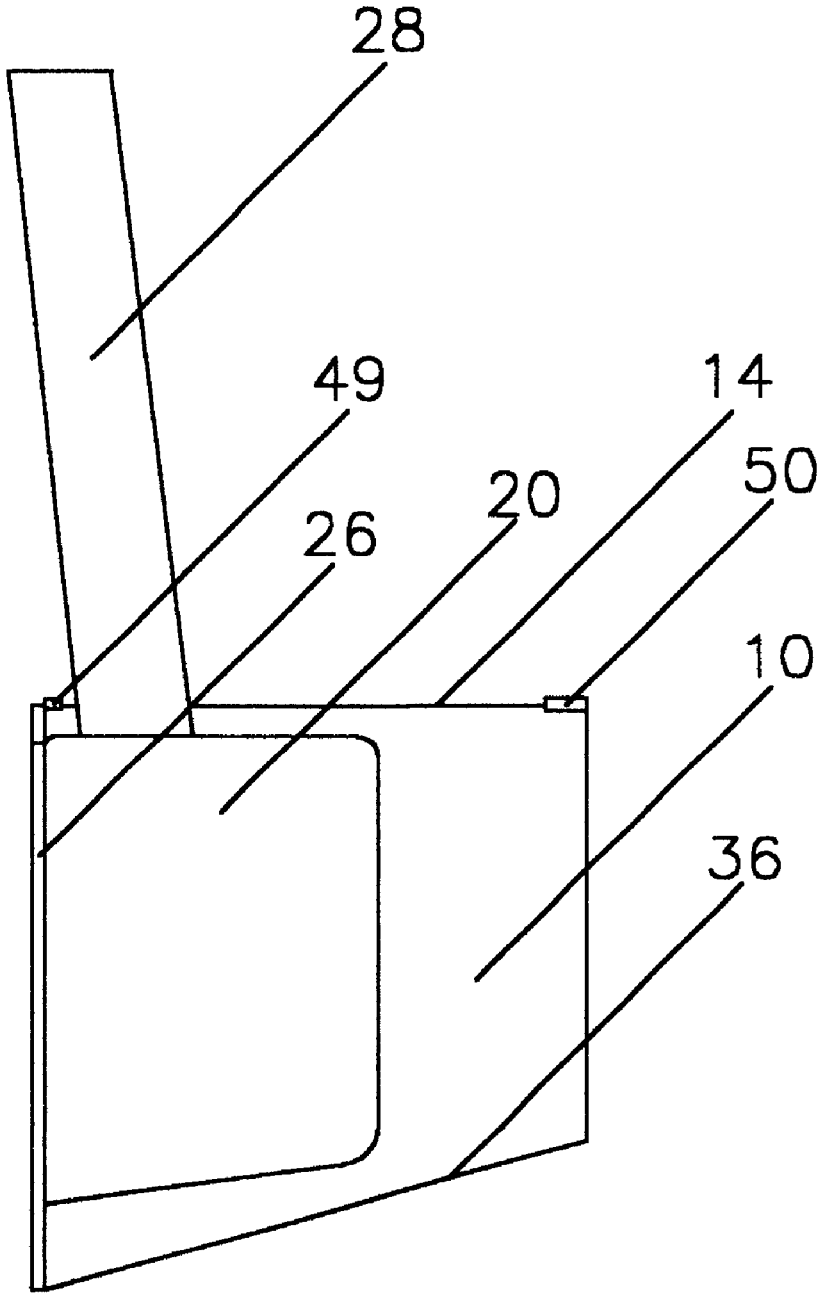
FIG. 6 is a side view of putterhead with a bore through shaft, bottom of arms and strike-barrel having different angles in the rear upward directions, sole of strike-barrel is considerably truncated. Strike-barrel extends considerably farther rearwards than the arms. Width of hosel-base and the offset-angle are reduced.
Figure 7:
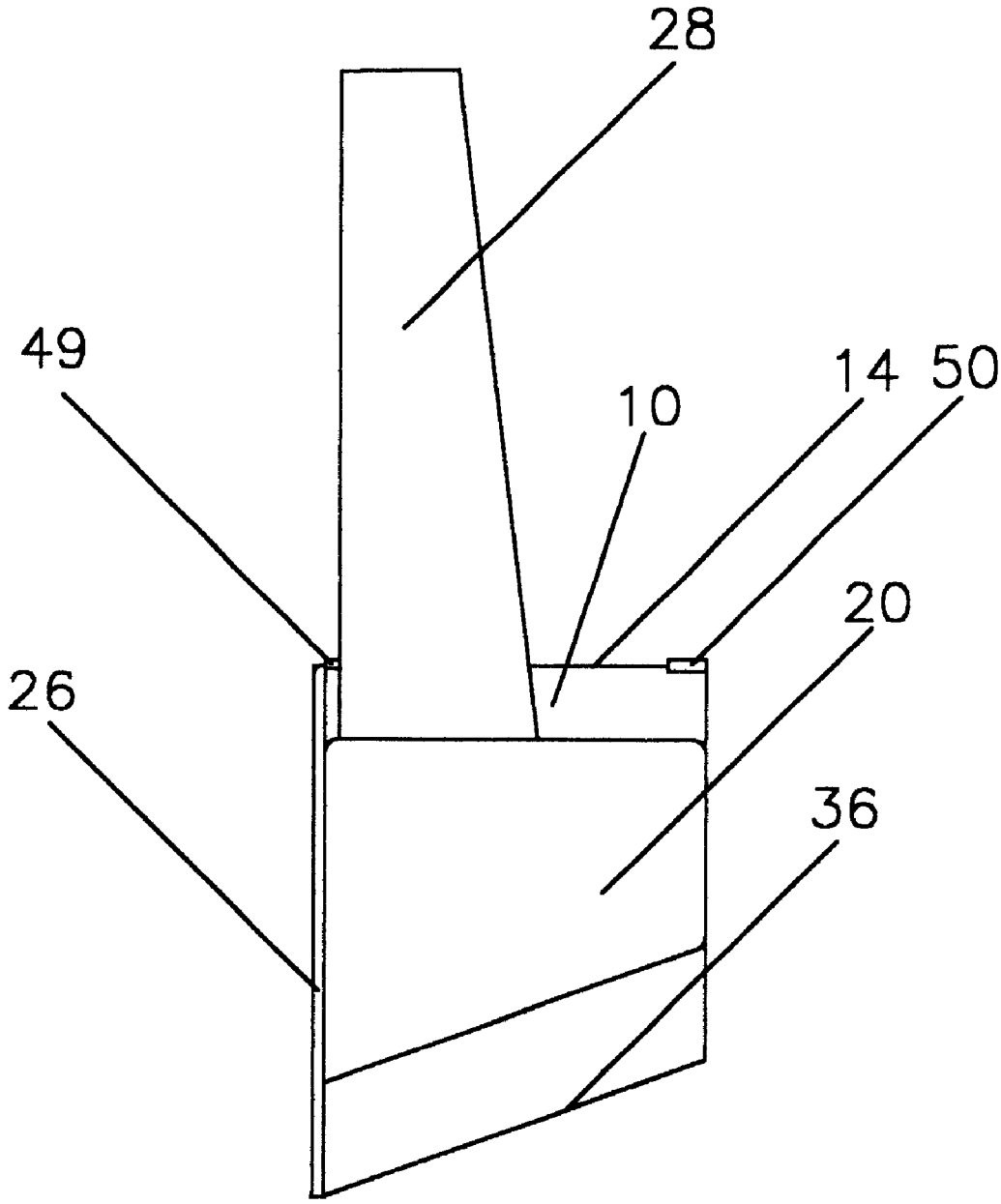
FIG. 7 is a side view of putterhead with hosel-base reduced in width and horizontal heel/toe projections.

In the preferred embodiment, strike-barrel is six-sided with the bottom rounded out, but strike-barrel can be constructed many sided, round, or oval. Strike-barrel preferably extends slightly rearwards longer than the arms, but may be the same length or shorter than the arms. FIG. 6 shows a putter clubhead with strike-barrel extending considerably longer beyond the arms; while FIG. 7 shows a strike-barrel that does not extend beyond the arms at all. Strike-barrel may extend above arms or may be equal in height or below the arm surfaces. In other embodiments, strike-barrel is hollow in the front, and capped only with a faceplate with or without a clubface-insert, so that the sweetspot has only the thickness of the face-plate or the clubface-insert. The pockets in strike-barrel, heel/toe, and hosel are shown as circular drilled out pockets, but these pockets can be constructed in any shape still accomplishing the desired air drag.

FIG. 6 shows the rear underside of strike-barrel is cut at much more severe angle upward than arms; while in FIG. 7, the underneath of both arms and strike-barrel are cut at the same severe angle. FIG. 5, the clubhead sole is constructed as a single moderate angle rearward and upward. FIGS. 5 and 7 show the underneath angles of arms, and the strike-barrel constructed parallel with one another; while FIG. 6 shows the underside of the strike-barrel, trimmed towards the rear in a sever angle from horizontal. This feature can especially be used for clubheads made for a long putter which are usually constructed larger than the traditional style putters. Trimming the bottom rear of strike-barrel, such as shown in FIG. 6, will help prevent clubhead from catching on the grass during swing.

FIG. 6 and FIG. 7 (side views) show some variations of the heel and toe projections. These projections are raised slightly from the top of arms, and angled upward towards the rear of the clubhead. In other embodiments, heel and toe projections may also be the edge of arms, constituting the heel and toe of clubhead, and not extended above the surface of the arm members. In FIG. 5, the heel and toe projections are made of two different angles; while in FIG. 6 the heel and toe projections are single slightly angled upward from horizontal. In FIG. 7, the heel and toe edges are constructed horizontally.

The face-plate can be constructed with the same or different height as the arms and strike-barrel.

Figure 8:
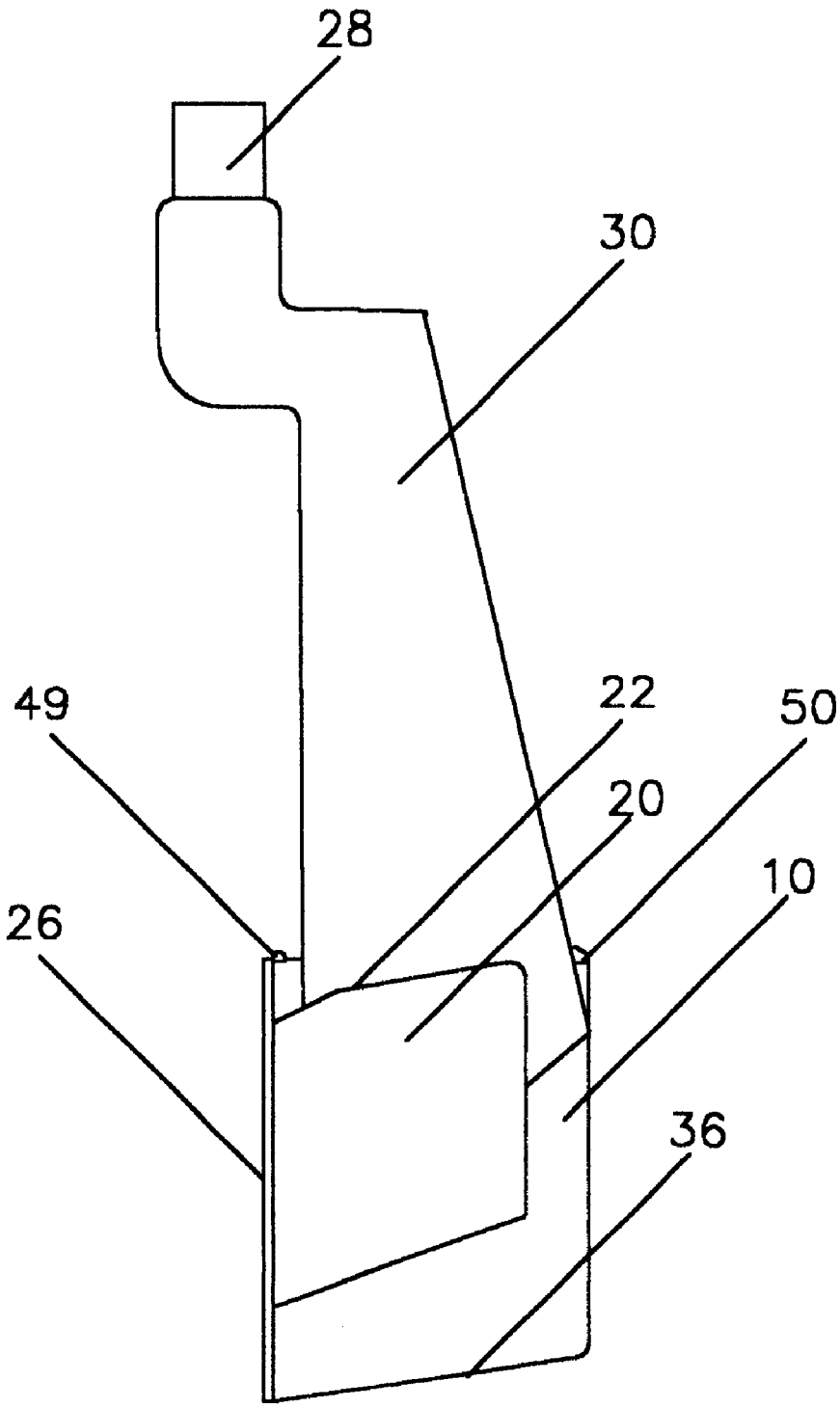
FIG. 8 is side view with a hosel top socket shaped to receive an inside-the-hosel shaft, round shaped bead-marks, and underneath side of strike-barrel and arm members having different upward angles. Hosel is elogated vertically to near maximum allowable by rules of golf.

FIG. 6 shows a putterhead wherein shaft enters the strike-barrel on the heel side through a bore, directly behind the sweetspot; however a straight or a bent shaft can enter any part of the clubhead at a different angle as allowed by the rules of golf. Clubheads can be constructed with various shaft-to-clubface-offset angles as shown in drawings FIGS. 5, 6, 7 and 8. Clubhead can be made to receive an over-the-hosel as in FIG. 5 and FIG. 7., or inside-the-hosel shaft as in FIG. 8. Hosel can be relatively short in height or widened as in FIG. 8. Putter clubhead can be heel-shafted where the heel converts into a hosel.

Bead-mark, may be different in number and shape than shown in preferred embodiment. For instance, one on each end of strike-barrel, or more on each end. Bead-marks can be round as in FIG. 8, or rectangular or triangular in shape as in FIG. 5 and FIG. 6. Bead-marks, and or the top ridge, may be raised from the strike-barrel or indented as a groove, or painted on the surface of the strike-barrel. Bead-marks can be an external attachment to the strike-barrel, or made from the same piece of material.

Vertical grooves are provided on the face of clubhead for on-target visual aid; but the clubface may be smooth, textured, dotted, or with other than vertical grooves. The grooves provided on the face of the strike-barrel and arms may go in the same direction or in different directions.

In putter clubheads, the face-plate and or the clubface-insert may be omitted, reducing cost. Putter clubheads may be made one piece, still maintaining the described features of strike-barrel, arms, and hosel. In the one-piece construction, the leading edge of the club is preferably constructed with a raised ridge of approximately 3 mm, but this ridge can be omitted. In other multi-piece embodiments, the strike-barrel and arm members can be made of one piece of material, and then attached to the heel and toe, which are made of a heavier material. The clubface-insert can be made smaller, or larger than shown in the preferred embodiment.

In the preferred embodiment, strike-barrel is six-sided with the bottom rounded out, but strike-barrel can be constructed many sided, round, or oval. Strike-barrel preferably extends slightly rearwards longer than the arms, but may be the same length or shorter than the arms. FIG. 6 shows a putter clubhead with strike-barrel extending considerably longer beyond the arms; while FIG. 7 shows a strike-barrel that does not extend beyond the arms at all. Strike-barrel may extend above arms or may be equal in height or below the arm surfaces. In other embodiments, strike-barrel is hollow in the front, and capped only with a faceplate with or without a clubface-insert, so that the sweetspot has only the thickness of the face-plate or the clubface-insert. The pockets in strike-barrel, heel/toe, and hosel are shown as circular drilled out pockets, but these pockets can be constructed in any shape still accomplishing the desired air drag.

Advantages

My clubhead features a hollowed strike-barrel which is centrally located and positioned parallel to the target line. In a putter clubhead, the strike-barrel is made visually strong by a channel separating it from the arms; and further visual separation features such as color, texture and difference in materials used. The strike-barrel thus creates a strong parallel axis which intuitively helps the golfer in precise alignment, and focuses the golfer to swing parallel along the target line, rather than trying to sweep the face of the clubhead perpendicular to the target line.

The heel and toe project higher than the top surface of arms in an angle slightly upwards towards the rear, thus creating a more aerodynamic clubhead. The uplifted heel and toe projections, plus somewhat hollowed cantilever arms, help the clubhead to stay more stable during the stroke and on track longer, thereby making it easier to swing the club in a controlled manner. The sides of heel and toe are relatively smooth and flat to allow for manufacturer names and logos, but are constructed at an angle so that such markings are not visible to the golfer when the golfer is at address position.

The central body of a putter clubhead is made of a light material, such as an aluminum alloy. The heel/toe are made of a heavier material such as tungsten alloy or stainless steel. This configuration provides a lighter mass in the middle that improves control during a stroke. The face-plate is made of nickel steel and contains an insert made of precious metal such as gold or silver for transmitting better feel to the golfer.

The sweetspot (center of strike-barrel face) has a relatively thin wall in the middle for better feel when an ideal impact is made. The strike-barrel walls provide additional mass directly behind the area of the face where a great majority of golfers tend to mis-hit a shot (up to about 25 mm from center). The strike-barrel walls increases in thickness in a graduating manner so that the farther away from the sweetspot, the more weight is available behind the clubface imparting relatively more force to the golf ball. The added weight offsets the loss of distance and accuracy normally incurred by the off-center club-ball impact. The weighting system behind the usual mis-hit-area coupled with the natural heel-toe weighting provided by the mass of the heavier materials used for the heel and toe, will achieve greater forgiveness than ever for off-center hits.

The strike-barrel is preferably further marked with a sighting mechanism (bead-marks) usually used in objects designed for accuracy such as guns and rifles. It is anticipated that this proven aiming apparatus will also aid the golfer in aiming as it does the marksman, even though the golfer is standing to the side of the ball. The familiarity and skill achieved by some golfers who have used firearms will further increase the sharpness of focus and aim for these golfers.

To assist the golfer who uses perpendicular aiming method (aligning the leading edge of club perpendicular to the target), the face-plate and the leading edge of clubhead are positioned slightly higher than the arms. This narrow leading edge according to my research with putters provided up to 7 degrees more aiming accuracy than a putter used with a ½" thick top line.

The golfer can use the top edge of the heel and toe projections (which is at 90 degrees to the clubface) as additional parallel alignment aids. The predominant feature of the strike-barrel positioned centrally, will assist the golfers who uses the entire club-head for alignment. Furthermore, when the club is placed behind the ball, the bottom edge of the strike-barrel is more similar in shape and size to the cross section of a golf ball resting on the putting green, thus more useful for intuitive alignment with the ball. This somewhat round sole of the strike-barrel is easier to align with the ball and target, especially on hilly ground, than the flatter sole of traditional golf clubs; because it is easier to align the center of two circles of similar size together than to align the center of a circle with the center of a rectangle.

Clubhead sole angles upward from the front to the rear of clubhead. This angle is made severe in some embodiments to create a higher center of gravity for the clubhead, to impart truer roll on the ball.

The club-heads shown in the embodiments contains a series of pockets (strike-barrel pocket, arm pockets, hosel pockets, heel and toe pockets) at the rear. The air resistance and drag from these pockets will significantly slow the back swing of the golfer while rendering the forward swing speed unaffected, thus promoting a more ideal golf swing.

The clubhead (especially for putters) is constructed with a hosel which is substantially longer at the base than the top portion and similar in overall shape to a rectangle. The widened base is positioned parallel to the target line. This construction will help in keeping the clubhead moving towards the target longer, and reduces the golfer's tendency to pull the club to the inside at impact with the ball.

CONCLUSION, RAMIFICATIONS, AND SCOPE

This invention addresses some of the major issues in golf club design and incorporates the solutions in a golf club which when viewed from the golfer's perspective (top view) does not look too radical from the clubs used in the last thirty years. It provides a golf club which is easier to align and stroke, and facilitates a more efficient golf swing. The usual mis-hit area is approximately up to 15 mm for putters and up to 25 mm for other clubs. The walls thickness of the strike-barrel is positioned behind the usual mis-hit-area so that the farther away the impact is made from the sweetspot, the more weight is imparted to the golf ball. This system provides a club which is more forgiving than ever before.

Strike-barrel can be constructed wider in the rear and narrower toward the club face. This feature will give a further directional aiming aid towards the target. Strike-barrel may also be made shorter, equal, or longer than the arms dimension longitudinally (FIGS. 5, 6, and 7), with graduating walls thickness as in the preferred embodiment or with constant walls thickness. The strike barrel may be incorporated inside a clubhead without any exterior appearance.

The putter club-head of the preferred embodiment is made of four different materials; but the entire club-head may be made of one or more pieces and of materials such as any steel alloy, plastics, or others. The entire club-head, or any part of it, may be cast, forged, carved, or milled. The overall size and weight of the club-head is preferably similar to what is commonly used today (for putters approximately 2xxx–3xxx grams, 115 mm in width, 25 mm in depth, and 25 mm in height), but could be made larger or smaller using some or all of the features described in the specifications. Even though a contrast in color between the strike-barrel and arm members is more effective, the club-head can be made of one or more colors or combination of colors.

The putter clubhead may be used for use with any length of shaft, and the shaft may attach to the clubhead at any point on the clubhead allowed by the golf ruling bodies.

Clubheads can be made for right-handed or left-handed golfers. Because of the symmetrical shape of my putterhead, a center-shafted version is especially effective for use with the long putter shafts.

The preferred embodiment is built with upstanding heel/toe projections such as previously used in some jet aircraft, in order to create an aerodynamic clubhead which is easier to keep on track. But manufacturing may be made easier by minimizing or omitting the arms and or the heel and toe projections.

One or many bead-marks similar to a gun barrel can be used for more accurate parallel aiming, or can be totally omitted in some models. Bead-marks may be rectangular, circular, oval, or other shapes. Grooves may be omitted on the entire club face, front of arm members, and or clubface-insert.

The clubface-insert is a thin piece of precious metal such as gold or silver alloy for transmitting better feel of impact to the golfer's hands, in order to provide better touch for the strike which is made on the sweetspot. The shape of the clubface-insert on the sweetspot is shown as a circle, but can be oval or many sided and can be made smaller or equal to the club-face. The clubface-insert may be omitted, or made with less expensive material which reduces manufacturing cost.

Arms, heel, and toe, are shown in figures with one top and one bottom surfaces; but could be constructed with one or many layers of surfaces, accomplishing additional air drag. The pockets of the strike-barrel, arm members, and hosel, or heel and toe are preferably left open from the rear; however, these pockets can be filled with relatively lightweight or porous material, or be capped from the rear, vertically or at any angle from vertical. These pockets may be increased or decreased in numbers, or made shallow to form a cup, still accomplishing air drag.

Additional weights or walls thickness may be placed directly behind the arm face to compensate for the off-center hits which are even outside the mis-hit-area. In a multi-pieces putter clubhead, this effect is partially achieved by the large glue-notches provided on both sides of the strike-barrel.

The leading edge of arms and strike-barrel can also be shaded from light color on the heel and top to dark in the center of club-head. This feature makes the golf clubface look somewhat concave from the golfers perspective which further helps with alignment. An actual concave face is not intended here as it would be against the rules of golf.

Although above descriptions are specific, these specifications should not be construed as limiting the scope of the invention, but rather provide examples of some of the preferred embodiments of this invention. Appended claims and their legal equivalents determine the overall scope of the invention.

What is claimed is:

1. A golf club head comprising:

a) a body portion, a heel portion, and a toe portion, b) one side of said body portion forming a front striking face, the opposite side forming a rear of said club head, c) a variable weight distribution means for compensating the distance loss from contact made on a mis-hit area, wherein said body portion comprises a hollowed tubular shape having a conical shaped pocket, said tubular shape resembling a gun barrel to provide improved alignment of said club head and to indicate a clearly defined sweetspot; and d) a hosel for mounting a shaft, wherein said hosel is positioned between said tubular shape and said heel portion, so that the golfer's view of said tubular shape is unobstructed, thereby improving the alignment feature of said tubular shape.

2. The golf club head of claim 1, wherein a pocket is formed behind the sweetspot of said club head such that said body portion is made substantially thin at the region of the sweetspot, and said body portion is substantially thick at the region of the mis-hit area, in order to place more force behind the ball, thereby offsetting the loss of distance.

3. The golf club head of claim 1, wherein said club head is substantially thin at the region of the sweetspot, and gradually increases in weight away from the sweetspot, thereby placing progressively more weight behind the mis-hit area.

4. The golf club head of claim 3, wherein the area of gradual weight increase behind said front striking face is approximately limited to the mis-hit area.

5. The golf club head of claim 2, wherein said pocket is overall conical in shape.

6. The golf club head of claim 1, wherein said pocket in the rear of the sweetspot has a region that is less than 10 millimeters in diameter.

7. The golf club head of claim 1, wherein said body portion comprises a hollowed tubular shape having a conical shaped pocket, said tubular shape resembling a gun barrel to provide improved alignment of said club-head and to indicate a clearly defined sweetspot.

8. The golf club head of claim 1, wherein said heel and said toe portions extend upwardly from said body portion, thereby improving the acrodynamic characteristics and stability of said club head during a golf swing.

9. The golf club head of claim 1, further comprising:

at least two sight-marks positioned on top of said club head, wherein at least one sight-mark is positioned substantially on a top front center of said club head, and at least one sight-mark substantially on a top rear center of said club head, whereby the alignment of the center of the club head with a target line is improved.

10. The golf club head of claim 1, futher comprising:

a clubface insert positioned in said front striking face, wherein the dimension of said insert is substantially smaller than the dimension of a golf ball.

11. A golf club head comprising:

a) a body portion, a heel portion, and a toe portion, b) one side of said body portion forming a front striking face, the opposite side forming a rear of said club head, c) a variable weight distribution means for compensating the distance loss from contact made on a mis-hit area, wherein said body portion comprises a hollowed tubular shape having a conical shaped pocket, said tubular shape resembling a gun barrel to provide improved alignment of said club head and to indicate a clearly defined sweetspot; and d) a bore to receive a shaft, wherein said bore is positioned between said tubular shape and said heel portion, whereby the golfer's view of said tubular shape is unobstructed and the alignment feature of said tubular shape is improved.

12. The golf club head of claim 11, wherein a pocket is formed behind the sweetspot of said club head such that said body portion is made substantially thin at the region of the sweetspot, and said body portion is substantially thick at the region of the mis-hit area, in order to place more force behind the ball, thereby offsetting the loss of distance.

13. The golf club head of claim 12, wherein said pocket is overall conical in shape.

14. The golf club head of claim 11, wherein said club head is substantially thin at the region of the sweetspot, and gradually increases in weight away from the sweetspot, thereby placing progressively more weight behind the mis-hit area.

15. The golf club head of claim 14, wherein the area of gradual weight increase behind said front striking face is approximately limited to the mis-hit area.

16. The golf club head of claim 11, wherein said pocket in the rear of the sweetspot has a region of less than 10 millimeters in diameter on the front striking face.

17. The golf club head of claim 11, wherein the pocket provides air drag resistance.

* * * * *